US012649887B1

(12) United States Patent
Guo et al.

(10) Patent No.: US 12,649,887 B1
(45) Date of Patent: Jun. 9, 2026

(54) HIGH-CONCENTRATION FILLING SLURRY OF COAL GANGUE AND PREPARATION METHOD THEREOF

(71) Applicant: Taiyuan University of Science and Technology, Taiyuan (CN)

(72) Inventors: Shaoqing Guo, Taiyuan (CN); Meng Li, Taiyuan (CN); Libing Gao, Taiyuan (CN); Guohong Feng, Taiyuan (CN); Xianxian Wei, Taiyuan (CN); Yanzhi Cao, Taiyuan (CN)

(73) Assignee: Taiyuan University of Science and Technology, Taiyuan (CN)

( * ) Notice: Subject to any disclaimer, the term of this patent is extended or adjusted under 35 U.S.C. 154(b) by 0 days.

(21) Appl. No.: 19/180,298

(22) Filed: Apr. 16, 2025

(30) Foreign Application Priority Data

Apr. 18, 2024 (CN) ..... 202410465853.6

(51) Int. Cl.

| | |
|---|---|
| ***C10L 1/32*** | (2006.01) |
| ***C10L 1/10*** | (2006.01) |
| ***C10L 1/12*** | (2006.01) |
| ***C10L 1/14*** | (2006.01) |
| ***C10L 1/197*** | (2006.01) |
| ***C10L 1/238*** | (2006.01) |
| ***C10L 1/24*** | (2006.01) |

(52) U.S. Cl.
CPC ..... *C10L 1/326* (2013.01); *C10L 1/106* (2013.01); *C10L 1/146* (2013.01); *C10L 1/1275* (2013.01); *C10L 1/1291* (2013.01); *C10L 1/1976* (2013.01); *C10L 1/2381* (2013.01); *C10L 1/2437* (2013.01); *C10L 2250/04* (2013.01)

(58) Field of Classification Search
CPC ..... C10L 1/106; C10L 1/1275; C10L 1/1291; C10L 1/146; C10L 1/1976; C10L 1/2381; C10L 1/2437; C10L 1/326; C10L 2250/04
See application file for complete search history.

(56) References Cited

FOREIGN PATENT DOCUMENTS

| | | | |
|---|---|---|---|
| CN | 110423057 | A | 11/2019 |
| CN | 113443884 | A | 9/2021 |
| CN | 113955986 | A | 1/2022 |
| CN | 114560651 | A | 5/2022 |
| CN | 114804696 | A | 7/2022 |
| CN | 114958318 | A | 8/2022 |
| CN | 115028411 | A | 9/2022 |

(Continued)

OTHER PUBLICATIONS

English-language machine translation of CN 118878301 A (Year: 2024).*

(Continued)

*Primary Examiner* — James C Goloboy
(74) *Attorney, Agent, or Firm* — Pilloff Passino & Cosenza LLP; Rachel K. Pilloff; Sean A. Passino

(57) ABSTRACT

A high-concentration filling slurry of coal gangue and a preparation method thereof is provided. The high-concentration filling slurry of coal gangue includes the following components in parts by mass: 65-85 parts of filling aggregate (including coarse aggregate and fine aggregate), 0.001-0.01 part of suspending agent, 0.001-0.05 part of dispersing agent, 0.01-0.1 part of activating agent, and 0.001 part of solid agent. On this basis, the preparation method of high-concentration filling slurry of coal gangue is provided.

2 Claims, 1 Drawing Sheet

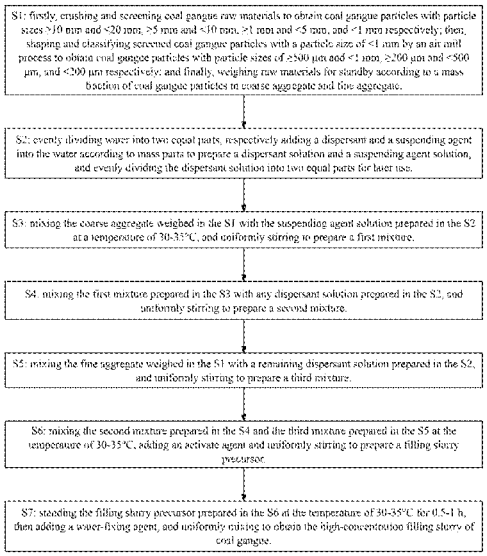

(56) References Cited

FOREIGN PATENT DOCUMENTS

| | | | | | |
|---|---|---|---|---|---|
| CN | 115066468 | A | | 9/2022 | |
| CN | 115259758 | A | | 11/2022 | |
| CN | 115893901 | A | | 4/2023 | |
| CN | 116835900 | A | | 10/2023 | |
| CN | 118878301 | A | * | 11/2024 | ..... C04B 18/12 |

OTHER PUBLICATIONS

Notice of first Office action dated May 30, 2024 in SIPO application No. 202410465853.6.
Retrieval report-First search dated May 10, 2024 in SIPO application No. 202410465853.6.
Notification to Grant Patent Right for Invention dated Jun. 20, 2024 in SIPO application No. 202410465853.6.
Retrieval report-Supplementary search dated Jun. 11, 2024 in SIPO application No. 202410465853.6.

* cited by examiner

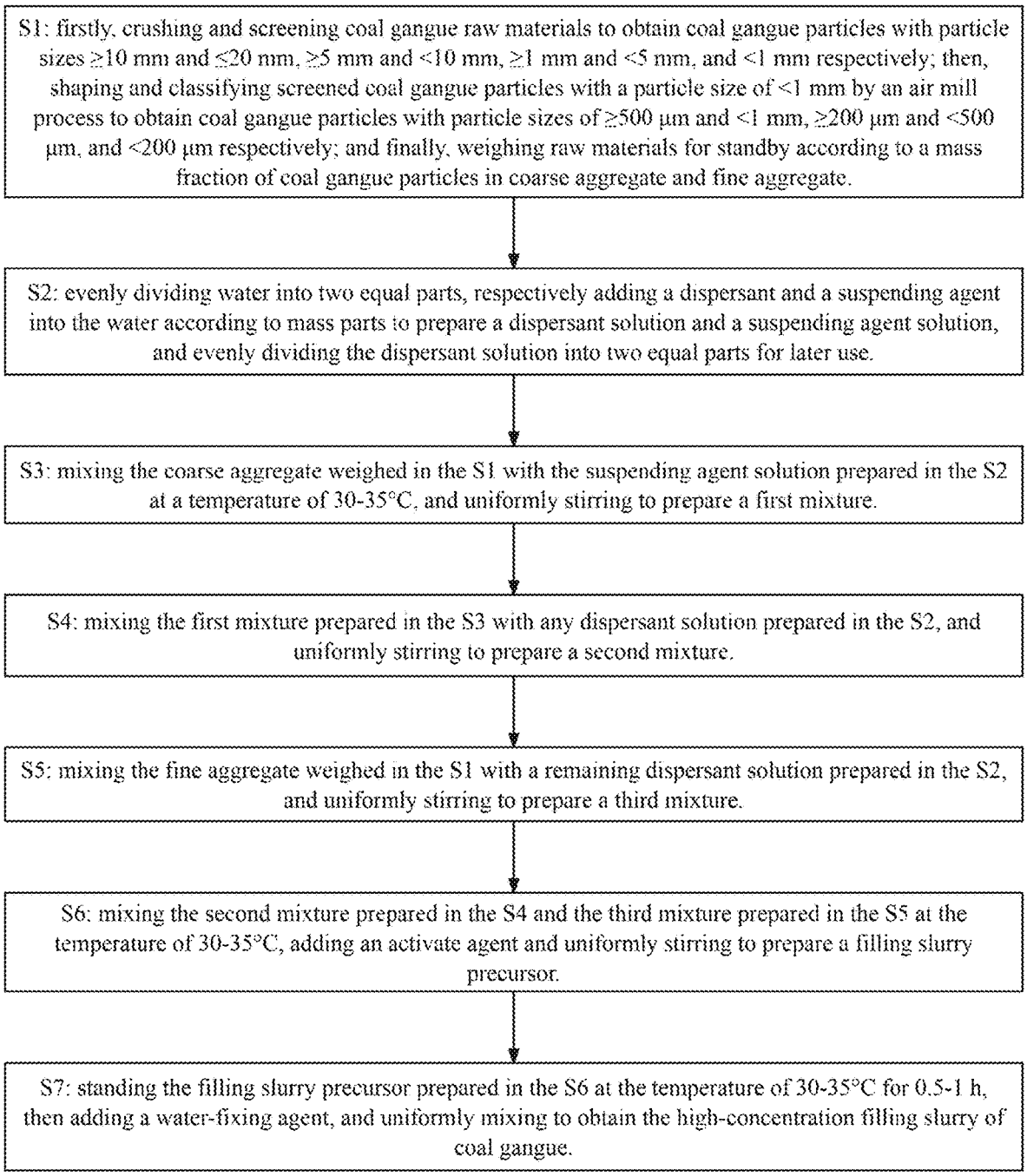
S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, shaping and classifying screened coal gangue particles with a particle size of <1 mm by an air mill process to obtain coal gangue particles with particle sizes of ≥500 μm and <1 mm, ≥200 μm and <500 μm, and <200 μm respectively; and finally, weighing raw materials for standby according to a mass fraction of coal gangue particles in coarse aggregate and fine aggregate.
S2: evenly dividing water into two equal parts, respectively adding a dispersant and a suspending agent into the water according to mass parts to prepare a dispersant solution and a suspending agent solution, and evenly dividing the dispersant solution into two equal parts for later use.
S3: mixing the coarse aggregate weighed in the S1 with the suspending agent solution prepared in the S2 at a temperature of 30-35°C, and uniformly stirring to prepare a first mixture.
S4: mixing the first mixture prepared in the S3 with any dispersant solution prepared in the S2, and uniformly stirring to prepare a second mixture.
S5: mixing the fine aggregate weighed in the S1 with a remaining dispersant solution prepared in the S2, and uniformly stirring to prepare a third mixture.
S6: mixing the second mixture prepared in the S4 and the third mixture prepared in the S5 at the temperature of 30-35°C, adding an activate agent and uniformly stirring to prepare a filling slurry precursor.
S7: standing the filling slurry precursor prepared in the S6 at the temperature of 30-35°C for 0.5-1 h, then adding a water-fixing agent, and uniformly mixing to obtain the high-concentration filling slurry of coal gangue.

HIGH-CONCENTRATION FILLING SLURRY OF COAL GANGUE AND PREPARATION METHOD THEREOF

CROSS-REFERENCE TO RELATED APPLICATIONS

This application claims priority to Chinese Patent Application No. 202410465853.6, filed on Apr. 18, 2024, the contents of which are hereby incorporated by reference.

TECHNICAL FIELD

The present disclosure belongs to the technical field of underground filling of coal gangue, in particular to high-concentration filling slurry of coal gangue and preparation method thereof.

BACKGROUND

Coal is an important energy source for industrial production. With a deepening of industrialization, an annual output of coal is expanding year by year. As a companion of coal, the amount of coal gangue is also increasing rapidly. However, gangue is a solid waste with low carbon content and high ash content, which needs to be separated before coal leaves the factory. At present, a comprehensive utilization rate of gangue in China is low (only about 30%). A traditional treatment method is to directly pile gangue on a surface to form a gangue hill. A waste dump will bring great threats and destruction to an ecological environment of a mining area, including occupying land and polluting air, water and soil, which will become a bottleneck restricting a green development of coal mines and seriously affect a sustainable development of coal mines. At the same time, due to a large-scale mining of underground coal resources, a goaf is formed, which leads to the redistribution of geostress field, accompanied by an emergence of mine dynamic phenomena, which in turn leads to dynamic disasters such as mine earthquake, rock burst and gas outburst, which seriously threatens the safety of mine production.

An underground separation of raw coal in coal mine-in-situ filling of gangue may significantly reduce an output of gangue and reduce a washing load of coal. It is not only of great significance to protect the environment and natural resources, but also meets requirements of green mining and developing circular economy. At the same time, it also reduces a transportation cost caused by ineffective lifting and transportation of gangue, avoids environmental problems caused by lifting and accumulation of gangue to a ground, and may also improve a yield of clean coal in raw coal, ultimately increasing an output of clean coal in coal mines and improving an income of coal mines. In addition, filling an underground sorted gangue into the goaf is helpful to liberate coal resources under the coal mining underbuildings, railways and water-bodies and improve a utilization efficiency of coal resources.

At present, an underground filling of coal gangue in coal mine is to mix a crushed coal gangue, ordinary portland cement, fly ash and water into paste slurry by a large filling station on the ground according to a certain proportion, and then pump the paste slurry to an underground filling working face by using a long-distance transportation pipeline. For example, China patent documents Composite additive for coal gangue filling material and preparation method and application thereof (publication number: CN115893901A) and Method for preparating paste filling material, slurry and filling body for a goaf (CN113443884A) disclose filling materials such as coal gangue, cement and fly ash are transported to underground for filling after being mixed on the ground, and at the same time, non-gangue materials such as cement and fly ash need to be purchased in a preparation process of gangue filling materials, which increases a preparation cost of gangue filling materials and fails to effectively utilize gangue. In addition, there is water bleeding during a curing process of a filling body, and water secreted penetrates into a groundwater area, which causes certain pollution to groundwater resources. Therefore, it is necessary to develop a kind of gangue filling material which does not secrete water and is suitable for in-situ filling of gangue underground and its preparation method.

SUMMARY

The main objective of the disclosure is to overcome shortcomings in the prior art, and solve technical problems of high cost of gangue filling materials, low utilization rate of gangue, and pollution of underground water resources caused by exudation of the filling body in the curing process. The disclosure provides a high-concentration filling slurry of coal gangue and preparation method thereof, where gangue particles with different millimeter and micron gradations are used as filling aggregates, and cement and fly ash are not needed, so a cost is low; because the surface of micron-sized gangue particles is excited by special activator, the surface of micron-sized gangue particles is self-cementing and easy to cure; due to the use of special water-retaining agent, the surface of micron-sized gangue particles does not secrete water; the filling material is convenient to be transported to the filling face through a pipeline during use, and shows good filling and curing performance, and at the same time, the filling material will not pollute the groundwater due to bleeding, which has good environmental benefits.

A design concept of the disclosure: a combination of millimeter and micron coal gangue particles is used as filling aggregate, where millimeter coal gangue particles are used as coarse aggregate and micron coal gangue particles are used as fine aggregate. At the same time, micron-sized coal gangue is rounded or oval by airflow grinding, which makes it play a role in lubricating the filling pipeline. In order to avoid a settlement of coarse aggregate, a suspending agent is added. In order to make the fine aggregate evenly distributed in the slurry, a dispersant is added. With a help of a friction of high-speed airflow on micron-sized coal gangue particles in a process of airflow shaping, micron-sized coal gangue particles are subjected to friction high-temperature effect in the process of airflow shaping, so the surface of micron-sized coal gangue particles presents certain cementing activity. Under an excitation of special activator, a cementation activity on the surface of micron-sized coal gangue particles is further stimulated, so the filling material can be cemented by itself without relying on external cementing agent. A special water-fixing agent is used to fix the water in the filling slurry, so the filling body will not secrete water after cementing and curing, thus avoiding the problem that groundwater resources are polluted during or after curing of the filling body, and effectively protecting the groundwater resources in the filling area. In the preparation process, the suspending agent is prepared into a solution, the solution is mixed with coarse aggregate at a temperature of 30° C.-35° C. and stirred evenly (only under this condition can the suspending agent play its role). At the same time, in order to make coarse aggregate and fine aggregate mix well, part of dispersant is added to the mixture of coarse aggregate and suspending agent in a form of solution, and part of dispersant is added to fine aggregate in the form of solution at the same time. Then the mixture containing coarse aggregate and the mixture containing fine aggregate are mixed at 30° C.-35° C. (under this condition, the mixed material can be guaranteed to be homogeneous slurry). After adding an active agent into the homogeneous slurry and stirring it evenly, let it stand for 0.5-1 h at the temperature of 30-35° C., so the activity of the active agent is gradually awakened during a standing process. And then adding a water-fixing agent and uniformly stirring to obtain high-concentration filling slurry of coal gangue.

The disclosure is realized by a following technical scheme.

A high-concentration filling slurry of coal gangue includes following components in parts by mass.

Filling aggregate: 65-85 parts; filling aggregate includes coarse aggregate and fine aggregate;

among them, the coarse aggregate includes coal gangue particles with following gradations:

- 20-30 parts of coal gangue particles with a particle size ≥10 mm and ≤20 mm;
- 20-30 parts of coal gangue particles with a particle size ≥5 mm and <10 mm; and
- 10-20 parts of coal gangue particles with a particle size ≥1 mm and <5 mm.

Fine aggregate includes coal gangue particles with following gradations:

- 5-10 parts of coal gangue particles with a particle size ≥500 μm and <1 mm;
- 5-10 parts of coal gangue particles with a particle size ≥200 μm and <500 μm;
- 5-10 parts of coal gangue particles with a particle size <200 μm;
- 0.001-0.01 part of suspending agent;
- 0.001-0.05 part of dispersant;
- 0.01-0.1 part of active agent;
- 0.001-0.01 part of water-fixing agent; and
- 20-35 parts of water.

The disclosure does not use cement and fly ash, and has advantages of low cost, easy solidification, no bleeding, convenient pipeline transportation to a filling working face, good filling performance and no pollution to groundwater.

In an embodiment, the suspending agent includes the following components in parts by mass: 1-10 parts of polycarboxylate and 1 part of sodium allyl sulfonate.

In an embodiment, the dispersant is sodium metasilicate or sodium disilicate.

In an embodiment, the active agent includes the following components in parts by mass: 1 part of desulfurized gypsum and 1-10 parts of water glass.

In an embodiment, a composition and parts by mass of the water-fixing agent are: 1 part of polyacrylamide, 1-5 parts of lignin and 1-10 parts of cellulose.

A preparation method of high-concentration filling slurry of coal gangue includes the following steps.

S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, screened coal gangue particles with a particle size of <1 mm are shaped and classified by an air mill process to obtain coal gangue particles with particle sizes of ≥500 μm and <1 mm, ≥200 μm and <500 μm, and <200 μm respectively; finally, according to a mass fraction of coal gangue particles in coarse aggregate and fine aggregate, raw materials are weighed for standby.

S2: evenly dividing the water into two equal parts, respectively adding the dispersant and the suspending agent into the water according to mass parts to prepare a dispersant solution and a suspending agent solution, and evenly dividing the dispersant solution into two equal parts for later use.

S3: mixing the coarse aggregate weighed in the S1 with the suspending agent solution prepared in the S2 at the temperature of 30-35° C., and uniformly stirring to prepare a first mixture.

S4: mixing the first mixture prepared in the S3 with any dispersant solution prepared in the S2, and uniformly stirring to prepare a second mixture.

S5: mixing the fine aggregate weighed in the S1 with a remaining dispersant solution prepared in the S2, and uniformly stirring to prepare a third mixture.

S6: mixing the second mixture prepared in the S4 and the third mixture prepared in the S5 at the temperature of 30-35° C., adding an active agent and uniformly stirring to prepare a filling slurry precursor.

S7: standing the filling slurry precursor prepared in the S6 at the temperature of 30-35° C. for 0.5-1 h, then adding a water-fixing agent, and uniformly mixing to obtain the high-concentration filling slurry of coal gangue.

The disclosure has the following beneficial effects.

The high-concentration filling slurry of coal gangue prepared by the methods provided by the disclosure has good suspension and fluidity, and the slurry can maintain good fluidity within 60 min.

The curing time of the high-concentration filling slurry of coal gangue prepared by the methods provided by the disclosure is within 2 hours, and the filling slurry has good water retention, and the filling body does not secrete water and pollute groundwater, which is beneficial to protecting groundwater resources in the filling area.

The high-concentration filling slurry of coal gangue prepared by the methods provided by the disclosure can make full use of coal gangue resources without outsourcing fly ash and cement, and has strong environmental protection benefits and economic benefits.

BRIEF DESCRIPTION OF THE DRAWING

The attached drawings, which constitute a part of the disclosure, are used to provide a further understanding of the disclosure. The illustrative embodiments of the disclosure and descriptions are used to explain the disclosure, and do not constitute an improper limitation of the disclosure.

This FIGURE is a flow chart of a preparation method of high-concentration filling slurry of coal gangue.

DETAILED DESCRIPTION OF THE EMBODIMENTS

In order to make the technical problems, technical schemes and beneficial effects to be solved by the present disclosure more clear, the following specific embodiments will further explain the present disclosure in detail. It should be understood that the specific embodiments described here are only used to explain the disclosure, and are not used to limit the disclosure.

Embodiment 1

A preparation method of high-concentration filling slurry of coal gangue (as shown in the FIGURE) includes the following steps.

S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, screened coal gangue particles with the particle size of <1 mm are shaped and classified by an air mill process to obtain coal gangue particles with particle sizes of ≥500 μm and <1 mm, ≥200 μm and <500 μm, and <200 μm respectively; finally, according to the mass fraction of coal gangue particles in coarse aggregate and fine aggregate, raw materials are weighed for standby;

among them, the coarse aggregate includes coal gangue particles with following gradations:

25 parts of coal gangue particles with a particle size ≥10 mm and ≤20 mm;

25 parts of coal gangue particles with a particle size ≥5 mm and <10 mm; and 10 parts of coal gangue particles with a particle size ≥1 mm and <5 mm.

Fine aggregate includes coal gangue particles with following gradations:

6 parts of coal gangue particles with particle size ≥500 μm and <1 mm;

6 parts of coal gangue particles with particle size ≥200 μm and <500 μm; and 8 parts of coal gangue particles with the particle size <200 μm.

S2: evenly dividing the water into two equal parts, adding 0.05 parts of the dispersant and 0.001 parts of the suspending agent into the water to prepare the dispersant solution and the suspending agent solution, and evenly dividing the dispersant solution into two equal parts for later use; among them, the dispersant is sodium metasilicate, and the composition and mass ratio of the suspending agent are: polycarboxylate: sodium allyl sulfonate=2:1.

S3: mixing the coarse aggregate weighed in the S1 with the suspending agent solution prepared in the S2 at the temperature of 35° C., and uniformly stirring to prepare the first mixture.

S4: mixing the first mixture prepared in the S3 with any dispersant solution prepared in the S2, and uniformly stirring to prepare the second mixture.

S5: mixing the fine aggregate weighed in the S1 with a remaining dispersant solution prepared in the S2, and uniformly stirring to prepare the third mixture.

S6: mixing the second mixture prepared in the S4 and the third mixture prepared in the S5 at the temperature of 35° C., adding 0.01 parts of the active agent and uniformly stirring to prepare a filling slurry precursor; among them, the composition and mass ratio of the active agent are: desulfurization gypsum:water glass=1:3.

S7: standing the filling slurry precursor prepared in the S6 at the temperature of 35° C. for 1 h, then adding 0.005 parts of the water-fixing agent, the composition and mass ratio of water-fixing agent are: polyacrylamide: lignin:cellulose=1:1:2, obtaining the high-concentration filling slurry of coal gangue after uniform mixing, the high-concentration filling slurry of coal gangue has good suspension and fluidity, and may maintain good fluidity within 60 min, and the curing time is 2 h.

Embodiment 2

A preparation method of high-concentration filling slurry of coal gangue (as shown in the FIGURE) includes the following steps.

S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, screened coal gangue particles with the particle size of <1 mm are shaped and classified by an air mill process to obtain coal gangue particles with particle sizes of ≥500 μm and <1 mm, ≥200 μm and <500 μm, and <200 μm respectively; finally, according to the mass fraction of coal gangue particles in coarse aggregate and fine aggregate, raw materials are weighed for standby;

among them, the coarse aggregate includes coal gangue particles with following gradations:

30 parts of coal gangue particles with a particle size ≥10 mm and ≤20 mm;

20 parts of coal gangue particles with a particle size ≥5 mm and <10 mm; and 10 parts of coal gangue particles with a particle size ≥1 mm and <5 mm.

Fine aggregate includes coal gangue particles with following gradations:

5 parts of coal gangue particles with particle size ≥500 μm and <1 mm;

5 parts of coal gangue particles with particle size ≥200 μm and <500 μm; and 5 parts of coal gangue particles with the particle size <200 μm.

S2: evenly dividing the water into two equal parts, adding 0.05 parts of the dispersant and 0.001 parts of the suspending agent into the water to prepare the dispersant solution and the suspending agent solution, and evenly dividing the dispersant solution into two equal parts for later use; among them, the dispersant is sodium metasilicate, and the composition and mass ratio of the suspending agent are: polycarboxylate: sodium allyl sulfonate=1:1.

S3: mixing the coarse aggregate weighed in the S1 with the suspending agent solution prepared in the S2 at the temperature of 30° C., and uniformly stirring to prepare the first mixture.

S4: mixing the first mixture prepared in the S3 with any dispersant solution prepared in the S2, and uniformly stirring to prepare the second mixture.

S5: mixing the fine aggregate weighed in the S1 with a remaining dispersant solution prepared in the S2, and uniformly stirring to prepare the third mixture.

S6: mixing the second mixture prepared in the S4 and the third mixture prepared in the S5 at the temperature of 30° C., adding 0.01 parts of the active agent and uniformly stirring to prepare a filling slurry precursor; among them, the composition and mass ratio of the active agent are: desulfurization gypsum:water glass=1:1.

S7: standing the filling slurry precursor prepared in the S6 at the temperature of 30° C. for 0.5 h, then adding 0.001 parts of the water-fixing agent, the composition and mass ratio of water-fixing agent are: polyacrylamide: lignin:cellulose=1:1:1, obtaining the high-concentration filling slurry of coal gangue after uniform mixing, the high-concentration filling slurry of coal gangue has good suspension and fluidity, and may maintain good fluidity within 50 min, and the curing time is 1 h and 50 min.

Embodiment 3

A preparation method of high-concentration filling slurry of coal gangue (as shown in the FIGURE) includes the following steps.

S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, screened coal gangue particles with the particle size of <1 mm are shaped and classified by an air mill process to obtain coal gangue particles with particle sizes of ≥500 μm and <1 mm, ≥200 μm and <500 μm, and <200 μm respectively; finally, according to the mass fraction of coal gangue particles in coarse aggregate and fine aggregate, raw materials are weighed for standby;

among them, the coarse aggregate includes coal gangue particles with following gradations:

25 parts of coal gangue particles with a particle size ≥10 mm and ≤20 mm;

25 parts of coal gangue particles with a particle size ≥5 mm and <10 mm; and 10 parts of coal gangue particles with a particle size ≥1 mm and <5 mm.

Fine aggregate includes coal gangue particles with following gradations:

10 parts of coal gangue particles with particle size ≥500 μm and <1 mm;

5 parts of coal gangue particles with particle size ≥200 μm and <500 μm; and 5 parts of coal gangue particles with the particle size <200 μm.

S2: evenly dividing the water into two equal parts, adding 0.01 parts of the dispersant and 0.01 parts of the suspending agent into the water to prepare the dispersant solution and the suspending agent solution, and evenly dividing the dispersant solution into two equal parts for later use; among them, the dispersant is sodium disilicate, and the composition and mass ratio of the suspending agent are: polycarboxylate:sodium allyl sulfonate=5:1.

S3: mixing the coarse aggregate weighed in the S1 with the suspending agent solution prepared in the S2 at the temperature of 35° C., and uniformly stirring to prepare the first mixture.

S4: mixing the first mixture prepared in the S3 with any dispersant solution prepared in the S2, and uniformly stirring to prepare the second mixture.

S5: mixing the fine aggregate weighed in the S1 with a remaining dispersant solution prepared in the S2, and uniformly stirring to prepare the third mixture.

S6: mixing the second mixture prepared in the S4 and the third mixture prepared in the S5 at the temperature of 35° C., adding 0.01 parts of the active agent and uniformly stirring to prepare a filling slurry precursor; among them, the composition and mass ratio of the active agent are: desulfurization gypsum:water glass=1:5.

S7: standing the filling slurry precursor prepared in the S6 at the temperature of 35° C. for 0.5 h, then adding 0.005 parts of the water-fixing agent, the composition and mass ratio of water-fixing agent are: polyacrylamide: lignin:cellulose=1:2:3, obtaining the high-concentration filling slurry of coal gangue after uniform mixing, the high-concentration filling slurry of coal gangue has good suspension and fluidity, and may maintain good fluidity within 40 min, and the curing time is 1 h and 30 min.

Embodiment 4

A preparation method of high-concentration filling slurry of coal gangue (as shown in the FIGURE) includes the following steps.

S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, screened coal gangue particles with the particle size of <1 mm are shaped and classified by an air mill process to obtain coal gangue particles with particle sizes of ≥500 μm and <1 mm, ≥200 μm and <500 μm, and <200 μm respectively; finally, according to the mass fraction of coal gangue particles in coarse aggregate and fine aggregate, raw materials are weighed for standby;

among them, the coarse aggregate includes coal gangue particles with following gradations:

30 parts of coal gangue particles with a particle size ≥10 mm and ≤20 mm;

25 parts of coal gangue particles with a particle size ≥5 mm and <10 mm; and 10 parts of coal gangue particles with a particle size ≥1 mm and <5 mm.

Fine aggregate includes coal gangue particles with following gradations:

5 parts of coal gangue particles with particle size ≥500 μm and <1 mm;

5 parts of coal gangue particles with particle size ≥200 μm and <500 μm; and 5 parts of coal gangue particles with the particle size <200 μm.

S2: evenly dividing the water into two equal parts, adding 0.01 parts of the dispersant and 0.005 parts of the suspending agent into the water to prepare the dispersant solution and the suspending agent solution, and evenly dividing the dispersant solution into two equal parts for later use; among them, the dispersant is sodium metasilicate, and the composition and mass ratio of the suspending agent are: polycarboxylate: sodium allyl sulfonate=2:1.

S3: mixing the coarse aggregate weighed in the S1 with the suspending agent solution prepared in the S2 at the temperature of 33° C., and uniformly stirring to prepare the first mixture.

S4: mixing the first mixture prepared in the S3 with any dispersant solution prepared in the S2, and uniformly stirring to prepare the second mixture.

S5: mixing the fine aggregate weighed in the S1 with a remaining dispersant solution prepared in the S2, and uniformly stirring to prepare the third mixture.

S6: mixing the second mixture prepared in the S4 and the third mixture prepared in the S5 at the temperature of 33° C., adding 0.01 parts of the active agent and uniformly stirring to prepare a filling slurry precursor; among them, the composition and mass ratio of the active agent are: desulfurization gypsum:water glass=1:10.

S7: standing the filling slurry precursor prepared in the S6 at the temperature of 33° C. for 0.8 h, then adding 0.001 parts of the water-fixing agent, the composition and mass ratio of water-fixing agent are: polyacrylamide: lignin:cellulose=1:5:1, obtaining the high-concentration filling slurry of coal gangue after uniform mixing, the high-concentration filling slurry of coal gangue has good suspension and fluidity, and may maintain good fluidity within 55 min, and the curing time is 1 h and 45 min.

Embodiment 5

A preparation method of high-concentration filling slurry of coal gangue (as shown in the FIGURE) includes the following steps.

S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, screened coal gangue particles with the particle size of <1 mm are shaped and classified by an air mill process to obtain coal gangue particles with particle sizes of ≥500 μm and <1 mm, ≥200 μm and <500 μm, and <200 μm respectively; finally, according to the mass fraction of coal gangue particles in coarse aggregate and fine aggregate, raw materials are weighed for standby;

among them, the coarse aggregate includes coal gangue particles with following gradations:

25 parts of coal gangue particles with a particle size ≥10 mm and ≤20 mm;

25 parts of coal gangue particles with a particle size ≥5 mm and <10 mm; and 10 parts of coal gangue particles with a particle size ≥1 mm and <5 mm.

Fine aggregate includes coal gangue particles with following gradations:

5 parts of coal gangue particles with particle size ≥500 μm and <1 mm;

8 parts of coal gangue particles with particle size ≥200 μm and <500 μm; and 10 parts of coal gangue particles with the particle size <200 μm.

S2: evenly dividing the water into two equal parts, adding 0.05 parts of the dispersant and 0.01 parts of the suspending agent into the water to prepare the dispersant solution and the suspending agent solution, and evenly dividing the dispersant solution into two equal parts for later use; among them, the dispersant is sodium disilicate, and the composition and mass ratio of the suspending agent are: polycarboxylate:sodium allyl sulfonate=4:1.

S3: mixing the coarse aggregate weighed in the S1 with the suspending agent solution prepared in the S2 at the temperature of 30° C., and uniformly stirring to prepare the first mixture.

S4: mixing the first mixture prepared in the S3 with any dispersant solution prepared in the S2, and uniformly stirring to prepare the second mixture.

S5: mixing the fine aggregate weighed in the S1 with a remaining dispersant solution prepared in the S2, and uniformly stirring to prepare the third mixture.

S6: mixing the second mixture prepared in the S4 and the third mixture prepared in the S5 at the temperature of 30° C., adding 0.1 parts of the active agent and uniformly stirring to prepare a filling slurry precursor; among them, the composition and mass ratio of the active agent are: desulfurization gypsum:water glass=1:10.

S7: standing the filling slurry precursor prepared in the S6 at the temperature of 30° C. for 1 h, then adding 0.01 parts of the water-fixing agent, the composition and mass ratio of water-fixing agent are: polyacrylamide: lignin:cellulose=1:5:10, obtaining the high-concentration filling slurry of coal gangue after uniform mixing, the high-concentration filling slurry of coal gangue has good suspension and fluidity, and may maintain good fluidity within 45 min, and the curing time is 1 h and 35 min.

The above is only the specific embodiment of the present disclosure, but the protection scope of the present disclosure is not limited to this, and any change or substitution that can be easily thought of by a person familiar with the technical field within the technical scope disclosed by the present disclosure should be included in the protection scope of the present disclosure. Therefore, the protection scope of the present disclosure should be based on the protection scope of the claims.

What is claimed is:

1. A high-concentration filling slurry of coal gangue, wherein the high-concentration filling slurry of coal gangue comprises following components in parts by mass:

filling aggregate: 65-85 parts; the filling aggregate comprises coarse aggregate and fine aggregate;

wherein the coarse aggregate comprises coal gangue particles with following gradations:

20-30 parts of coal gangue particles with a particle size ≥10 mm and ≤20 mm;

20-30 parts of coal gangue particles with a particle size ≥5 mm and <10 mm; and 10-20 parts of coal gangue particles with a particle size ≥1 mm and <5 mm;

the fine aggregate comprises coal gangue particles with following gradations:

5-10 parts of coal gangue particles with a particle size ≥500 μm and <1 mm;

5-10 parts of coal gangue particles with a particle size ≥200 μm and <500 μm; and 5-10 parts of coal gangue particles with a particle size <200 μm;

0.001-0.01 part of a suspending agent; wherein the suspending agent comprises the following components in parts by mass: 1-10 parts of polycarboxylate and 1 part of sodium allyl sulfonate;

0.001-0.05 part of a dispersant; wherein the dispersant is sodium metasilicate or sodium disilicate;

0.01-0.1 part of an active agent; wherein the active agent comprises the following components in parts by mass: 1 part of desulfurization gypsum and 1-10 parts of water glass;

0.001-0.01 part of a water-fixing agent; wherein the water-fixing agent comprises the following components in parts by mass: 1 part of polyacrylamide, 1-5 parts of lignin and 1-10 parts of cellulose; and 20-35 parts of water.

2. A preparation method of the high-concentration filling slurry of coal gangue according to claim 1, comprising following steps:

S1: firstly, crushing and screening coal gangue raw materials to obtain coal gangue particles with particle sizes ≥10 mm and ≤20 mm, ≥5 mm and <10 mm, ≥1 mm and <5 mm, and <1 mm respectively; then, shaping and classifying screened coal gangue particles with a particle size of <1 mm by an air mill process to obtain coal gangue particles with particle sizes of ≥500 μm and <1 mm, ≥200 μm and <500 μm, and <200 μm respectively; and finally, weighing raw materials for standby according to a mass fraction of coal gangue particles in coarse aggregate and fine aggregate;

S2: evenly dividing water into two equal parts, respectively adding the dispersant and the suspending agent into the water according to mass parts to prepare a dispersant solution and a suspending agent solution, and evenly dividing the dispersant solution into two equal parts for later use;

S3: mixing the coarse aggregate weighed in the S1 with the suspending agent solution prepared in the S2 at a temperature of 30-35° C., and uniformly stirring to prepare a first mixture;

S4: mixing the first mixture prepared in the S3 with any dispersant solution prepared in the S2, and uniformly stirring to prepare a second mixture;

S5: mixing the fine aggregate weighed in the S1 with a remaining dispersant solution prepared in the S2, and uniformly stirring to prepare a third mixture;

S6: mixing the second mixture prepared in the S4 and the third mixture prepared in the S5 at the temperature of 30-35° C., adding the active agent and uniformly stirring to prepare a filling slurry precursor; and S7: standing the filling slurry precursor prepared in the S6 at the temperature of 30-35° C. for 0.5-1 h, then adding the water-fixing agent, and uniformly mixing to obtain the high-concentration filling slurry of coal gangue.

* * * * *